US010273775B2

(12) United States Patent
Cruickshanks et al.

(10) Patent No.: US 10,273,775 B2
(45) Date of Patent: Apr. 30, 2019

(54) APPARATUS AND METHOD FOR TESTING A BLOWOUT PREVENTER

(71) Applicant: AKER SOLUTIONS LIMITED, London (GB)

(72) Inventors: Simon Cruickshanks, Maidenhead (GB); Andy Dyson, Maidenhead (GB); Peter Saville, Maidenhead (GB); Stephen Ogg, Maidenhead (GB)

(73) Assignee: AKER SOLUTIONS LIMITED, London (GB)

( * ) Notice: Subject to any disclaimer, the term of this patent is extended or adjusted under 35 U.S.C. 154(b) by 0 days.

(21) Appl. No.: 15/429,399

(22) Filed: Feb. 10, 2017

(65) Prior Publication Data

US 2017/0241230 A1 Aug. 24, 2017

(30) Foreign Application Priority Data

Feb. 19, 2016 (GB) ..... 1602942.3

(51) Int. Cl.
*E21B 34/04* (2006.01)
*E21B 47/00* (2012.01)
*E21B 33/064* (2006.01)

(52) U.S. Cl.
CPC ..... *E21B 33/064* (2013.01); *E21B 34/045* (2013.01); *E21B 47/0001* (2013.01)

(58) Field of Classification Search
CPC ... E21B 33/064; E21B 34/045; E21B 47/0001
See application file for complete search history.

(56) References Cited

U.S. PATENT DOCUMENTS 3,662,823 A * 5/1972 Murman ..... E21B 33/064 166/338
3,870,101 A * 3/1975 Helmus ..... E21B 29/04 166/322
3,897,824 A * 8/1975 Fisher ..... E21B 33/06 166/188

(Continued)

FOREIGN PATENT DOCUMENTS

GB 2330160 A 4/1999
GB 2398309 A 8/2004

(Continued)

OTHER PUBLICATIONS

UK IPO Search Report Cover letter dated Aug. 8, 2016 and Search Report dated Aug. 5, 2016 in GB Patent Application No. 1602942.3.

(Continued)

*Primary Examiner* — James G Sayre
(74) *Attorney, Agent, or Firm* — Nixon & Vanderhye P.C.

(57) ABSTRACT

An apparatus including a drilling tool for locating in a wellhead has fluid ports therein. The apparatus further includes a collar which is mateable with the drilling tool, such that the fluid ports in the drilling tool are blocked by the collar when the collar is mated with the drilling tool. The drilling tool can be a bit runnable drill string tool. The apparatus may also include a bit runnable wear bushing. The apparatus can advantageously be used to perform a method of testing a blowout preventer (BOP) on a subsea wellhead.

19 Claims, 3 Drawing Sheets

(56) References Cited

U.S. PATENT DOCUMENTS

| | | | | | |
|---|---|---|---|---|---|
| 4,018,276 | A * | 4/1977 | Bode | E21B 33/06 | 166/183 |
| 4,553,591 | A * | 11/1985 | Mitchell | E21B 33/03 | 166/86.2 |
| 4,554,976 | A * | 11/1985 | Hynes | E21B 47/1025 | 166/337 |
| 4,559,809 | A * | 12/1985 | Mayo | E21B 47/1025 | 73/40.5 R |
| 4,828,024 | A * | 5/1989 | Roche | E21B 21/001 | 137/869 |
| 5,860,478 | A * | 1/1999 | Coutts | E21B 34/045 | 166/356 |
| 5,890,541 | A * | 4/1999 | Jennings | E21B 33/064 | 166/250.08 |
| 6,302,211 | B1 | 10/2001 | Nelson et al. | | |
| 7,284,616 | B2 * | 10/2007 | Williams | E21B 17/1007 | 166/381 |
| 2004/0200614 | A1 | 10/2004 | Stjernstrom et al. | | |
| 2005/0103503 | A1 * | 5/2005 | Williams | E21B 17/1007 | 166/381 |
| 2008/0017383 | A1 | 1/2008 | Minassian et al. | | |

FOREIGN PATENT DOCUMENTS

| | | | | |
|---|---|---|---|---|
| GB | 2440265 | A * | 1/2008 | E21B 17/1007 |
| WO | 2015/112021 | A1 | 7/2015 | |

OTHER PUBLICATIONS

3-Hour Toe in the Water Search Report on GB Patent Application No. 1602942.3 dated Feb. 3, 2016.

* cited by examiner

APPARATUS AND METHOD FOR TESTING A BLOWOUT PREVENTER

CROSS-REFERENCE TO RELATED APPLICATION

This application claims priority to GB Patent Application No. 1602942.3 filed Feb. 19, 2016, the entire content of which is hereby incorporated by reference.

TECHNICAL FIELD

The present invention relates to an apparatus for blocking fluid ports in a drilling tool and a method of testing a blowout preventer (BOP) in a subsea wellhead, the method including the step of blocking the aforementioned fluid ports.

BACKGROUND

When a crude oil and/or natural gas well is being drilled a blowout preventer (BOP) is used to protect the personnel and equipment that are drilling the well. A blowout preventer (BOP) is a mechanical device, often a valve, that can seal off the oil and/or gas well in the event of an uncontrolled fluid flow or release from the well, and thus prevent a blowout.

It is necessary to regularly test the blowout preventer (BOP) to ensure the safety of the personnel, equipment and natural environment. There are often legal requirements to perform BOP tests at regular intervals. This typically involves abandoning drilling operations prior to reaching target depth and pulling the drill string back to surface.

The present invention aims to provide a new apparatus for and a new method of testing a blowout preventer (BOP).

In accordance with a first aspect of the present invention there is provided an apparatus comprising:

- a drilling tool for locating in a wellhead, the drilling tool having fluid ports therein; and
- a collar, the collar being mateable with the drilling tool;
- wherein the fluid ports in the drilling tool are blocked by the collar when the collar is mated with the drilling tool.

BRIEF SUMMARY

The collar may be referred to as a cap. The collar or cap may be referred to as a sub. A surface of the collar is typically complementary with a surface of the drilling tool. The surfaces are typically complementary so that the fluid ports in the drilling tool are readily blocked by the collar when the drilling tool and collar are mated together.

The drilling tool is typically securable in the wellhead. The wellhead is typically located subsea.

The apparatus may further comprise a wear bushing for locating in the wellhead. The wear bushing is typically securable in the wellhead.

The drilling tool may be one or more of a drill string tool, a drill string adapter, a bit runnable tool and a bit runnable drill string tool. The drilling tool may be selectively retrievable.

When the apparatus further comprises a wear bushing the wear bushing may be retrievable from the wellhead. The retrievable wear bushing can be run and retrieved with a drill bit and/or bottom hole assembly. The wear bushing is typically releasably coupleable to the drilling tool. The wear bushing may be a selectively retrievable wear bushing. The drilling tool may be referred to as a selectively retrievable wear bushing tool. The wear bushing typically remains in the wellhead when a drill bit and/or a bottom hole assembly is being retrieved. The wear bushing may be referred to as a bit runnable wear bushing.

The drilling tool may be sealable against the wear bushing. An outer surface of the drilling tool is typically sealable against an inner surface of the wear bushing. The drilling tool typically has an O-ring and/or PolyPak™ seal on an outer surface.

The drilling tool is normally part of a drill string. The drill string typically comprises one or more of drill pipe, drill string tool(s), drill collar(s) and a drill bit.

The wear bushing and drilling tool are typically part of and/or in a wellhead or wellhead assembly.

There may be a blowout preventer (BOP) on the wellhead. It may be an advantage of the present invention that the collar can be used to block the fluid ports in the drilling tool, thereby allowing the drilling tool and/or wear bushing to remain in the wellhead when the blowout preventer (BOP) is being tested, typically pressure tested.

The apparatus typically allows for the installation of a wear bushing, selectively retrieving the wear bushing, and testing a blowout preventer (BOP) in a subsea wellhead. It may be an advantage of the present invention that the apparatus typically allows for testing the blowout preventer (BOP) in the same operation as running the bit runnable wear bushing. This saves rig time especially in deep water as it means the full drill string does not need to be recovered to surface to perform a blowout preventer (BOP) test.

The fluid ports in the drilling tool may be referred to as flow-by holes. The fluid ports are typically used to provide fluid communication between a first end or side and an opposite second end or side of the drilling tool and/or wear bushing when the drilling tool and/or wear bushing is/are in a wellhead.

The drilling tool, and that is one or more of a drill string tool, a drill string adapter, a bit runnable tool and a bit runnable drill string tool, is typically used to run the wear bushing into the wellhead.

The wear bushing is typically used to protect the bore of a subsea wellhead from wear or damage when the well is being drilled. After drilling the well, when casing hangers are installed, metal to metal seals are used to seal between the wellhead and a casing hanger. If the bore of the wellhead has been damaged during drilling, it is difficult and often impossible to form an adequate metal to metal seal(s) between the wellhead and casing hanger.

The apparatus may further comprise a mandrel. The mandrel may be attachable, typically releasably attachable, to the drilling tool. The drilling tool and/or wear bushing may have an aperture therein. Typically the aperture passes through the center of the drilling tool and/or wear bushing. The mandrel may be a central mandrel, passable through the aperture of the drilling tool and/or wear bushing. The central mandrel is normally securable, typically releasably securable, to the drilling tool. The drilling tool is normally securable, typically releasably securable, to the wear bushing.

The mandrel normally has one or more shear pins for attaching the mandrel to the drilling tool or vice versa. The mandrel may have one or more dogs for attaching, typically releasably attaching, the mandrel to the drilling tool or vice versa. The mandrel typically has one or more spring loaded dogs for releasably attaching the mandrel to the drilling tool or vice versa if the drilling tool is to remain in the wellhead during and/or after drilling.

The mandrel typically has one or more J-lugs or keys that are locatable in J-slots in the drilling tool. The mandrel can be manipulated relative to the drilling tool to attach and release the mandrel from the drilling tool. The mandrel is typically attached to the drilling tool when the drilling tool is being run into a wellhead. The mandrel is typically released from the drilling tool during drilling operations downhole.

The one or more J-lugs or keys are normally spaced around an outer circumference of the mandrel. The one or more J-slots are normally spaced around an inner circumference of the drilling tool.

In accordance with a second aspect of the present invention there is provided a method of testing a blowout preventer (BOP) on a subsea wellhead, the method including the steps of:

- locating a drilling tool in a wellhead, the drilling tool having fluid ports therein;
- running a collar into the wellhead, the collar mating with the drilling tool;
- blocking the fluid ports in the drilling tool using the collar; and
- pumping a fluid into a chamber between the blowout preventer (BOP) on the wellhead and the collar.

The fluid ports in the drilling tool are typically blocked when the drilling tool and collar are mated together. The drilling tool and collar may in combination be referred to as apparatus and may be in accordance with the first aspect of the present invention.

The fluid is typically pumped into the chamber to build up the fluid pressure in the chamber. For the blowout preventer (BOP) test, typically pressure test, the fluid pressure in the chamber may be from 10,000 psi to 15,000 psi, normally from 3,000 psi to 5,000 psi and typically from 5,000 psi to 10,000 psi.

The blowout preventer (BOP) is normally considered to have passed the test, typically pressure test, if the fluid in the chamber at a fluid pressure of from 5,000 psi to 10,000 psi does not leak past the blowout preventer (BOP), seals and/or valves of the blowout preventer (BOP) and/or passed seals of the drilling tool and/or wear bushing.

The method may further include the step of attaching, typically releasably attaching, a mandrel to the drilling tool using one or more dogs on the mandrel.

The method may further include the step of locating a wear bushing in the wellhead. The drilling tool is typically releasably coupleable to the wear bushing. The method may further include the step of coupling, typically releasably coupling the drilling tool to the wear bushing. The drilling tool may be releasably coupled to the wear bushing using dogs on the drilling tool. When the drilling tool is coupled to the wear bushing it may be referred to being landed out on the wear bushing.

The drilling tool is normally part of a drill string. The drill string typically comprises one or more of drill pipe, drill string tool(s), drill collar(s) and a drill bit.

The method typically includes the step of pulling the drill string back a set distance to allow the collar to be attached to and/or made up with the drill string and then run back into the wellhead. The collar is typically run down into the wellhead on drill pipe until it lands off the drilling tool. When the collar has landed off the drilling tool the collar is typically mated with the drilling tool and thereby the fluid ports in the drilling tool are blocked.

The optional features of the first aspect of the present invention can be incorporated into the second aspect of the present invention and vice versa.

BRIEF DESCRIPTION OF THE DRAWINGS

An embodiment of the invention will now be described by way of example only and with reference to the accompanying drawings, in which.

DETAILED DESCRIPTION OF EXAMPLE EMBODIMENTS

Figure 1:
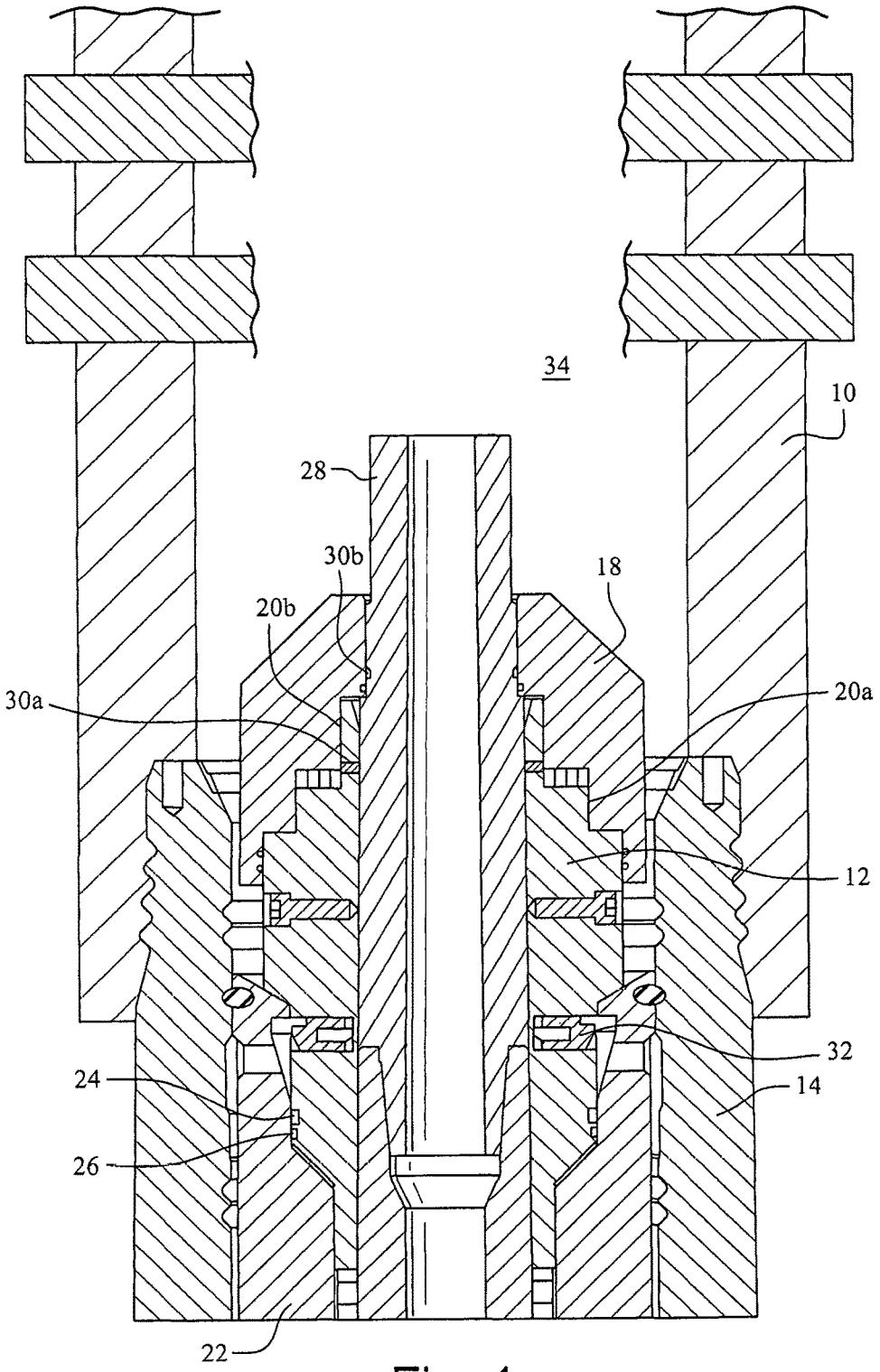
FIG. 1 is cross-sectional view of an apparatus according to an embodiment of the present invention.
Figure 2:
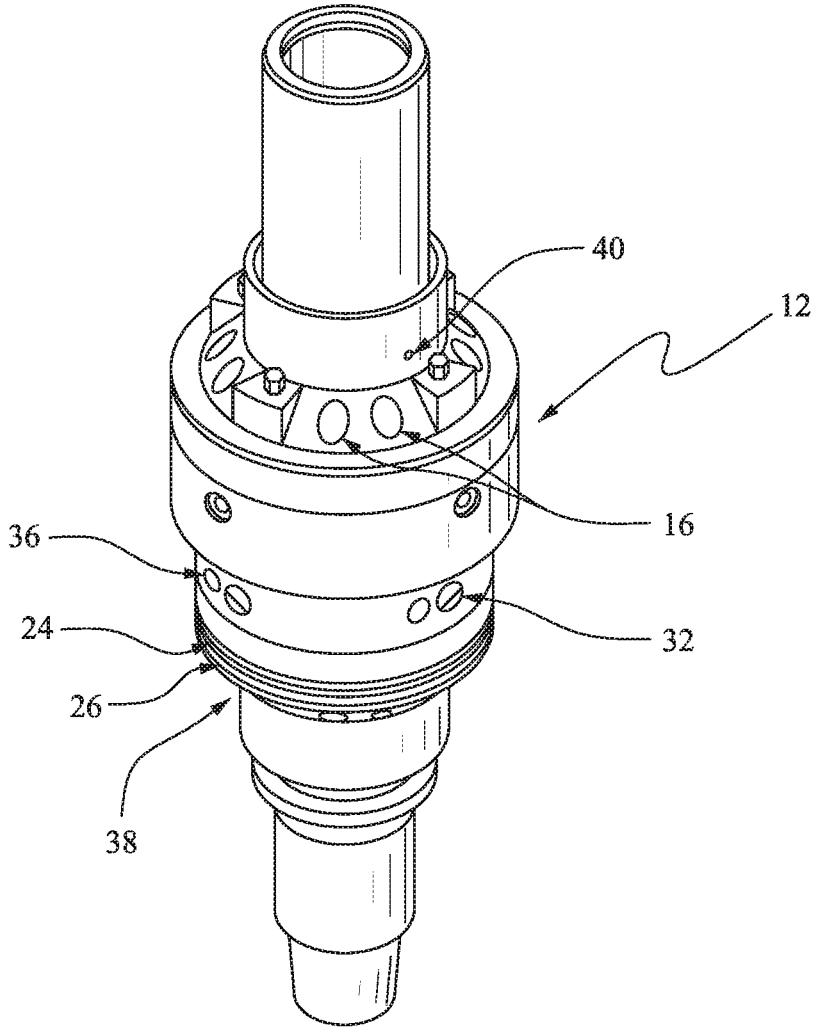
FIG. 2 is a perspective view of a drilling tool according to an embodiment of the present invention.

FIG. 1 shows a cross-sectional view of an apparatus 10 according to an embodiment of the present invention. The apparatus 10 comprises a drilling tool 12 for locating in a wellhead 14, the drilling tool having fluid ports therein (16, as shown in FIG. 2). The apparatus also comprises a collar 18, the collar being mateable with the drilling tool 12. The fluid ports (16, as shown in FIG. 2) in the drilling tool 12 are blocked by the collar 18 when the collar is mated with the drilling tool. The collar 18 is shown mated to the drilling tool 12 in FIG. 1.

A surface of the collar is complementary with a surface of the drilling tool as shown at 20*a* & 20*b*. The surfaces are complementary so that the fluid ports (16, as shown in FIG. 2) in the drilling tool 12 are blocked by the collar 18 when the drilling tool and collar are mated together, as shown in FIG. 1.

The apparatus 10 further comprises a wear bushing 22. The wear bushing 22 and drilling tool 12 are shown secured in the wellhead 14. The drilling tool 12 is a bit runnable drill string tool. The wear bushing 22 is a bit runnable wear bushing.

The drilling tool 12 is sealed against the wear bushing 22 using an O-ring 24 and PolyPak™ seal 26 on an outer surface of the drilling tool.

The apparatus 10 further comprises a mandrel 28. The mandrel is releasably attachable to the drilling tool 12. The mandrel 28 has one or more shear pins 30*a* & 30*b* (shown broken here) for attaching the mandrel to the drilling tool 12. There are one or more spring loaded dogs 32 for attaching the drilling tool 12 to the wear bushing 22.

The method of testing a blowout preventer (BOP) on a subsea wellhead 14 includes locating the drilling tool 12 in the wellhead, the drilling tool having fluid ports therein (16, as shown in FIG. 2). The collar 18 is run into the wellhead 14, the collar mating with the drilling tool 12. The collar 18 blocks the fluid ports (16, as shown in FIG. 2) in the drilling tool 12. Fluid (not shown) can then be pumped into a chamber, partly shown at 34, between the blowout preventer (BOP) 40 (shown schematically in FIG. 1) on the wellhead 14 and the collar 18.

In use the collar 18 is held onto the drilling tool 12, the collar 18 thereby being mated with the drilling tool 12, by fluid pressure. The fluid pressure or pressure of the fluid is that provided by the fluid pumped into the chamber, partly shown at 34, between the blowout preventer (BOP) (not shown) on the wellhead 14 and the collar 18.

When testing the blowout preventer (BOP) a plug (not shown) is put in the bore of the mandrel 28 to block this fluid path.

FIG. 2 shows a perspective view of the drilling tool 12 according to an embodiment of the present invention. The fluid ports 16 are shown. The drilling tool 12 also has one or more shear pins 36, that like spring loaded dogs 32, are used for running the wear bushing.

The mandrel 28 is part of the drill string (not shown). The drilling tool 12 also has an anti-rotation key 38 and shear pin 40.

Figure 3:
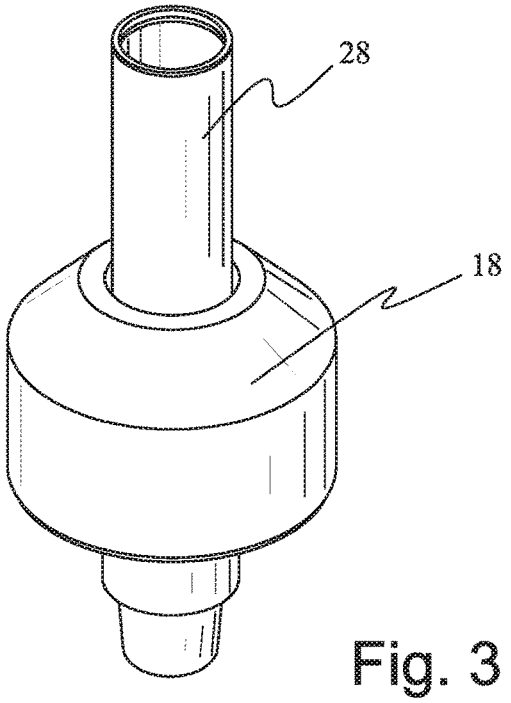
FIG. 3 is a perspective view of a collar according to an embodiment of the present invention.

FIG. 3 shows a perspective view of a collar 18 according to an embodiment of the present invention. The collar 18 is shown made up with the mandrel 28 as part of the drill string.

Figure 4:
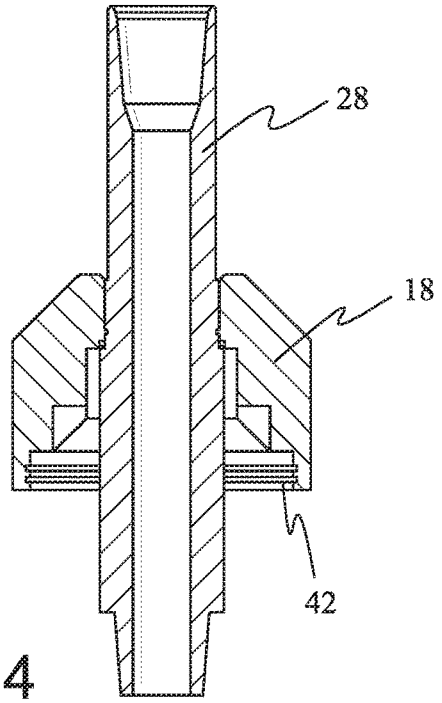
FIG. 4 is cross-sectional view of the collar shown in FIG. 3.

FIG. 4 shows a cross-sectional view of the collar 18 and mandrel 28 shown in FIG. 3. FIG. 4 also shows seals 42 on an inner surface of the collar 18. These are used to improve the seal between the collar 18 and drilling tool (12, as shown in FIGS. 1 & 2).

Modifications and improvements can be incorporated herein without departing from the scope of the invention.

The invention claimed is:

1. An apparatus comprising:

a drill bit mounted in a drill string;

a drilling tool mounted in the drill string, the drilling tool being configured to be located and used in a wellhead below a blowout preventer (BOP), the drilling tool having fluid ports therein; and a collar configured to be located between the drilling tool and the BOP, the collar being mateable with the drilling tool;

wherein the fluid ports in the drilling tool are blocked by the collar when the collar is mated with the drilling tool below a chamber in the BOP.

2. An apparatus according to claim 1, wherein a surface of the collar is complementary with a surface of the drilling tool so that the fluid ports in the drilling tool are readily blocked by the collar when the drilling tool and collar are mated together.

3. An apparatus according to claim 1, wherein the wellhead is located subsea.

4. An apparatus according to claim 1, wherein the drilling tool is one or more of a drill string tool, a drill string adapter, a bit runnable tool and a bit runnable drill string tool.

5. An apparatus according to claim 1, wherein the apparatus further comprises a wear bushing for locating in the well head, and, wherein the drilling tool is sealable against the wear bushing.

6. An apparatus according to claim 1, wherein the fluid ports are used to provide fluid communication between a first end and an opposite second end of the drilling tool when the drilling tool is in the wellhead.

7. An apparatus according to claim 1, wherein the apparatus further comprises a mandrel releasably attachable to the drilling tool.

8. A method of testing a blowout preventer (BOP) on a subsea wellhead, the method including the steps of:

locating a drilling tool in a wellhead below a BOP, the drilling tool having fluid ports therein;

running a collar into the wellhead, the collar mating with the drilling tool below the BOP;

blocking the fluid ports in the drilling tool using the collar; and pumping a fluid into a chamber between the blowout preventer (BOP) on the wellhead and the collar;

wherein the drilling tool is part of a drill string, the drill string comprising a drill bit.

9. A method according to claim 8, wherein the fluid is pumped into the chamber to build up the fluid pressure in the chamber.

10. A method according to claim 8, wherein for the blowout preventer (BOP) test, the fluid pressure in the chamber may be from 5,000 psi to 10,000 psi.

11. A method according to claim 8, wherein the blowout preventer (BOP) is considered to have passed the test if the fluid remains in the chamber at a fluid pressure of from 5,000 psi to 10,000 psi.

12. A method according to claim 8, wherein the method further includes the step of releasably attaching a mandrel to the drilling tool using one or more dogs on the mandrel.

13. A method according to claim 8, wherein the method further includes the step of locating a wear bushing in the wellhead, the drilling tool releasably coupleable to the wear bushing.

14. A method according to claim 8, the drill string comprising one or more of drill pipe, drill string tool(s), and drill collar(s).

15. A method according to claim 14, wherein the method includes the step of pulling the drill string back a set distance to allow the collar to be made up with the drill string and then run back into the wellhead.

16. A method according to claim 8, the method comprising drilling with the drill string, with the drilling tool mounted in the drill string.

17. An apparatus comprising:

a drilling tool configured to be located and used in a drill string with a drill bit in a wellhead below a blowout preventer (BOP), the drilling tool having fluid ports therein; and a collar configured to be located between the drilling tool and the BOP, the collar being mateable with the drilling tool; and a wear bushing for locating in the wellhead, wherein the fluid ports in the drilling tool are blocked by the collar when the collar is mated with the drilling tool below a chamber in the BOP.

18. The apparatus according to claim 17, wherein the wear bushing is configured to be attached to a mandrel with the drilling tool for at least one of run in; and retrieval.

19. The apparatus according to claim 17, wherein the drilling tool is configured to be located and used in the wellhead below the blowout preventer (BOP) by being attached to a mandrel while being run into the wellhead and being released from the mandrel during drilling operations downhole.

* * * * *